US012371767B2

(12) United States Patent
Yi et al.

(10) Patent No.: US 12,371,767 B2
(45) Date of Patent: Jul. 29, 2025

(54) HOT-WORKING DIE STEEL, HEAT TREATMENT METHOD THEREOF AND HOT-WORKING DIE

(71) Applicant: IRONOVATION MATERIALS TECHNOLOGY CO., LTD., Jiangsu (CN)

(72) Inventors: Hongliang Yi, Liaoning (CN); Lianqian Liu, Liaoning (CN); Guodong Wang, Liaoning (CN); Xiaochuan Xiong, Jiangsu (CN)

(73) Assignee: Ironovation Materials Technology Co., Ltd., Jiangsu (CN)

( * ) Notice: Subject to any disclaimer, the term of this patent is extended or adjusted under 35 U.S.C. 154(b) by 741 days.

(21) Appl. No.: 17/435,067

(22) PCT Filed: Oct. 18, 2019

(86) PCT No.: PCT/CN2019/111849
§ 371 (c)(1),
(2) Date: Aug. 31, 2021

(87) PCT Pub. No.: WO2020/177325
PCT Pub. Date: Sep. 10, 2020

(65) Prior Publication Data

US 2022/0162731 A1 May 26, 2022

(30) Foreign Application Priority Data

Mar. 1, 2019 (CN) ..... 201910156108.2

(51) Int. Cl.
*C22C 38/48* (2006.01)
*C21D 8/00* (2006.01)
(Continued)

(52) U.S. Cl.
CPC ..... *C22C 38/48* (2013.01); *C21D 8/005* (2013.01); *C21D 9/0068* (2013.01); *C22C 38/04* (2013.01);
(Continued)

(58) Field of Classification Search
CPC ..... C21D 1/18; C21D 6/02
See application file for complete search history.

(56) References Cited

U.S. PATENT DOCUMENTS 6,413,329 B1 7/2002 Nakatsu et al.
9,689,061 B2 6/2017 Angles
(Continued)

FOREIGN PATENT DOCUMENTS

CN 1263170 A 8/2000
CN 102676923 A 9/2012
(Continued)

OTHER PUBLICATIONS

International Search Report (with partial translation) and Written Opinion issued in corresponding International Patent Application No. PCT/CN2019/111849, dated Jan. 15, 2020.
(Continued)

*Primary Examiner* — Nicholas A Wang
(74) *Attorney, Agent, or Firm* — Morgan, Lewis & Bockius LLP

(57) ABSTRACT

The present invention relates to a hot-working die steel, a heat treatment method thereof and a hot-working die. Specifically, the present invention discloses a hot-working die steel, its alloying composition comprises, by weight percentage, Cu: 2~8%, Ni: 0.8~6%, and Ni:Cu≥0.4, C: 0~0.2%, Mo: 0~3%, W: 0~3%, Nb: 0~0.2%, Mn: 0~0.8%, Cr: 0~1%, the balance of Fe and other alloying elements and impurities. The present invention also discloses a heat treatment method for performing on the hot-working die steel. The present
(Continued)

Morphology and size of carbide precipitates invention further discloses a hot-working die formed of the hot-working die steel underwent through heat treatment according to the heat treatment method.

25 Claims, 4 Drawing Sheets

(51) Int. Cl.

| | |
|---|---|
| ***C21D 9/00*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |

(52) U.S. Cl.
CPC ..... *C22C 38/06* (2013.01); *C22C 38/42* (2013.01); *C22C 38/44* (2013.01)

(56) References Cited

U.S. PATENT DOCUMENTS

| | | | | |
|---|---|---|---|---|
| 2012/0063946 | A1* | 3/2012 | Valls ..... | C22C 38/44 420/108 |
| 2014/0178243 | A1 | 6/2014 | Valls Anglés | |
| 2018/0142317 | A1 | 5/2018 | Kim et al. | |
| 2021/0214818 | A1 | 7/2021 | Yi et al. | |

FOREIGN PATENT DOCUMENTS

| | | | | |
|---|---|---|---|---|
| CN | 103334052 | A | | 10/2013 |
| CN | 103484686 | A | | 1/2014 |
| CN | 103993223 | A | | 8/2014 |
| CN | 103333997 | B | | 12/2014 |
| CN | 106978564 | A | | 7/2017 |
| CN | 108085587 | A | | 5/2018 |
| CN | 108374127 | A | | 8/2018 |
| CN | 108441613 | A | | 8/2018 |
| JP | S63-183153 | A | | 7/1988 |
| JP | H04-263014 | A | | 9/1992 |
| JP | H07-278737 | A | | 10/1995 |
| JP | H07278737 | | * | 10/1995 |
| JP | H11-335775 | A | | 12/1999 |
| JP | 2001-152246 | A | | 6/2001 |
| JP | 2003-013174 | A | | 1/2003 |
| JP | 2004-277818 | A | | 10/2004 |
| JP | 2004277818 | | * | 10/2004 |
| JP | 2007-262569 | A | | 10/2007 |
| JP | 2015-007278 | A | | 1/2015 |
| JP | 2016-514211 | A | | 5/2016 |
| JP | 2018-035381 | A | | 3/2018 |
| WO | WO2014139451 | | * | 9/2014 |
| WO | 2017/168874 | A1 | | 10/2017 |

OTHER PUBLICATIONS

Extended European Search Report dated Apr. 12, 2022, issued in corresponding European Patent Application No. 19917811.2.
Office Action dated Oct. 24, 2023, issued in corresponding Japanese Patent Application No. 2021-551797.
JIS G 4404 from JIS Handbook 1, Japan Standards Association, Japan Standards Association, Jan. 19, 2007, pp. 1276 to 1280.
Office Action issued in counterpart Japanese Patent Application No. 2021-551797 dated Nov. 22, 2022.
Office Action dated Oct. 10, 2022, issued in corresponding Chinese Patent Application No. 202210317961.X.
Translation of Office Action dated Feb. 1, 2023, issued in corresponding Brazilian Patent Application No. 112021017349-8.
Japanese Classic Skills Series: Mold Material Properties and Applications, China Machine Press (2006), p. 113.
JIS G 4404, "Alloy tool steels", Japanese Standards Association (2006), p. 1-18.
Zhou Qingchun, "Study on the role of silicon in H13 hot working die steel", Dissertation, Shanghai University, (2012), p. 10.
Wang Xuesheng and Hui Hu eds., Pressure Vessels, (2018), p. 23 of Chapter 3.
Selin et al., (2009) Influence of alloying additions on microstructure and thermal properties in compact graphite irons, International Journal of Cast Metals Research, 22:1-4, 283-285, DOI: 10.1179/136404609X367984.
Selin et al., Regression Analysis of Thermal Conductivity Based on Measurements of Compacted Graphite Irons, Metallurgical and Materials Transactions A, vol. 40A, Dec. 2009, pp. 3235-3244.

* cited by examiner

Morphology and size of carbide precipitates

High-resolution morphology and size of Cu precipitates

High-resolution morphology and size of NiAl precipitates and the coherent relationship with the matrix Relationship between thermal conductivity and temperature of exemplary steels and compared steels

HOT-WORKING DIE STEEL, HEAT TREATMENT METHOD THEREOF AND HOT-WORKING DIE

TECHNICAL FIELD

The present invention relates to a hot-working die steel, a heat treatment method thereof and a hot-working die.

BACKGROUND

Hot-working die steel is a type of alloyed tool steel in which chromium, molybdenum, tungsten, vanadium and other alloying elements are added on the basis of carbon tool steel to improve hardenability, toughness, wear resistance and heat resistance. Hot-working die steel is often used for a die for material forming during die casting, forging, and extrusion. In recent years, the forming technology of advanced high-strength steel plates for automobiles which can meet both the lightweight and safety requirements of automobiles—hot stamping technology—has posed new requirements and challenges for die steel. The thermal conduction property of a die is directly related to the resistance to hot cracking, service life and the cycle time in production of the die.

Hot-working die steel used in many manufacturing processes is often subjected to high thermomechanical loads. These loads usually lead to thermal shock or thermal fatigue. For most of these tools, the main failure mechanisms include thermal fatigue and/or thermal shock, and usually include other degradation mechanisms as well, wherein such as mechanical fatigue, wear (abrasion, adhesion, corrosion and even cavities), fracture, sinking, or plastic deformation. In many other applications apart from the above-mentioned tools, the materials that are used also need to have a high resistance to thermal fatigue and properties to resist other failure mechanisms.

Thermal shock and thermal fatigue are induced by thermal gradients, the generation of which is because in most production application processes, due to exposure and limited energy of an energy source, the temperature is attenuated to a certain extent and thus heat cannot be transferred stably. Under this circumstance, with a given heat flux density function, the higher the thermal conductivity of a material, the lower the thermal gradient (because the thermal gradient is inversely proportional to the thermal conductivity), the lower the load on the surface of the material, and the lower the resulting thermal shock and thermal fatigue, which thereby can improve the service life of the material.

Die steel with high thermal conductivity can not only shorten the cycle time in a production process, but also enhance the resistance to hot cracking of the die due to its property of high thermal conductivity, thereby increasing the service life of the die. The commonly used die steels have thermal conductivity of approximately 18~24 W/mK at room temperature. Their thermal conductivity decreases as the temperature increases. Due to the low thermal conductivity, the thermal expansion difference caused by the temperature difference of the material during service leads to a high chance of forming thermal fatigue cracks in the die and thus a shortened service life of the die. In addition, the hardness of the carbide precipitated phase which ensures the wear resistance of the die steel is reduced at high temperatures, which leads to the problem of low wear resistance of the die at high temperatures.

U.S. Pat. No. 09,689,061B2 discloses an alloyed tool steel having high thermal conductivity, the alloyed chemical composition thereof by weight percentage is: C: 0.26~0.55%, Cr:<2%, Mo: 0~10%, W: 0~15%, Mo+W: 1.8~15%, Ti+Zr+Hf+Nb+Ta: 0~3%, V: 0~4%, Co: 0~6%, Si: 0~1.6%, Mn: 0~2%, Ni: 0~2.99%, S: 0~1%. This patent discloses that after solution treatment and hardening treatment, C element forms Mo, W carbides with Mo and W to substitute Cr carbides, improving the thermal conductivity of the alloyed tool steel.

Although the thermal conductivity of the tool steel is improved by substituting Cr carbides with Mo, W carbides in that patent, the size of the carbides is not easily controllable. The patent states that after undergoing solution treatment, primary carbides cannot completely dissolve into the matrix, and the size of the undissolved primary carbides is about 3 μm. During the service of the material, large-sized carbides would become sources of fatigue cracks, seriously affecting the fatigue life of the material. Moreover, large-sized carbides would also seriously deteriorate the toughness of the material. Domestic researchers have found that its maximum thermal conductivity at room temperature is about 47 W/mK, and the thermal conductivity decreases as the temperature increases. When the temperature is higher than 300° C., the thermal conductivity is lower than 39 W/mK. When the hardness value reaches 50 HRC or above, the impact energy (an unnotched sample of 7×10 mm) is <210 J. The thermal conductivity of the material decreases as the temperature increases. When it is used in a high-temperature environment, its advantage of high thermal conductivity is negligible. The material of this invention cannot achieve a good combination of high thermal conductivity, high toughness and high hardness.

Patent CN108085587A provides a hot-working die steel for long life cycle die casting having excellent thermal conductivity at high temperatures and method for preparing the same. The patent discloses that through reasonable proportions among elements, a hot-working die steel for long life cycle die casting having a high thermal conductivity can be obtained. Its chemical composition by weight percentage is: C: 0.35~0.45%, Si: 0.20~0.30%, Mn: 0.30~0.40%, Ni: 0.50~1.20%, Cr: 1.5~2.2%, Mo: 2~2.6%, W: 0.0001~1.0%, Ti: 0~0.40%, V: 0.30~0.50%. This patent substitutes Cr carbides by certain Mo, W carbides. However, firstly the size of the carbides is not easy to control, and the larger-sized carbides deteriorate the toughness; secondly after adding Ti, liquated TiN and larger-sized TiC tend to be formed, deteriorating the toughness; thirdly, tempering must be performed for multiple times, leading to complex processes; also a secondary hardening peak must be avoided, otherwise the material would have the greatest hardness but the poorest toughness. Therefore, in the U-notch impact test of the exemplary steel in the preferred embodiment, the impact energy does not exceed 50 J, and the maximum thermal conductivity is 35.982 W/mK.

Patents CN103333997B and CN103484686A provide H13 die steel, its chemical composition by weight is: C: 0.32~0.45%, Si: 0.80~1.20%, Mn: 0.20~0.50%, Cr: 4.75~5.50%, Mo: 1.10~1.75%, V: 0.80~1.20%, P: ≤0.030%, S: ≤0.030%. The steel has higher contents of C, Cr and Mo elements and thus has high hardenability and resistance to hot cracking and corrosion resistance. Carbon and vanadium of higher contents form VC, resulting in good wear resistance. Patent CN103333997B also provides an annealing process for H13 die steel as well as a method for refining carbides in H13 die steel.

The annealing process procedures of patent CN103333997B are complex, taking a long time, but can only solve the problem of element segregation to a certain extent, the size of the larger-sized primary carbides resulted from element segregation cannot be reduced. Moreover, the module would be seriously oxidized and decarburized if it is annealed at a temperature of above 1000° C. for a long time.

The method for refining carbides given in the patent CN103484686A is to add magnesium to a steel to reduce the precipitation of carbides, fulfilling the purpose of refining the carbides. However, the average diameter of the carbides given in the embodiments is 260 nm, i.e., the carbides have not been refined to below 100 nm. Moreover, the precipitation of carbides in H13 guarantees its high hardness. Reducing the precipitation of carbides would inevitably reduce the hardness of the material.

In H13 die steel, neither the carbon content nor the heat treatment process enables the carbide forming elements Cr, V, and Mo to form carbides and completely precipitate out of the matrix, especially Cr element. Cr dissolved into the matrix has a serious negative influence on the thermal conductivity of the steel, resulting in the maximum thermal conductivity of the steel not more than 24 W/mK. Amid increasing pursuit of higher efficiency and shorter cycle time in the production process, H13 is apparently no longer competitive, because its thermal conductivity can no longer be substantially improved. Therefore, H13 die steel does not have the property of high thermal conductivity.

SUMMARY OF THE INVENTION

The present invention has been made in view of the above problems existing in the prior art. An object of the invention is to provide a hot-working die steel, the material composition thereof is designed such that: after proper heat treatment, alloying elements are all precipitated from the matrix in the form of Cu pure metal phase and NiAl intermetallic compound, which reduces the lattice defects of the material matrix. Meanwhile, the precipitates have good thermal conductivity, thereby improving the thermal conductivity of the material, namely the thermal conductivity≥35 W/mK. And based on its precipitation strengthening, the hardness of greater than or equal to HRC 42 is achieved. In order to further improve the hardness of the material, precipitation of $(Mo, W)_3Fe_3C$, NbC and the like are introduced to achieve higher hardness.

Another object of the present invention is to provide a hot-working die steel which has the characteristics of high thermal conductivity, high hardness and high toughness. The primary carbides in the hot-working die steel have sizes of less than 100 nm; the secondary carbides, Cu precipitates and intermetallic compound NiAl precipitates have an average size of less than 10 nm; and the impact energy of an unnotched sample of 7×10 mm is ≥250 J.

Still another object of the present invention is to provide a heat treatment method which simplifies the steps of the heat treatment process for an existing die steel. Since the carbon content of the steel of the present invention is only 0~0.2 wt. %, far below 0.3~0.5 wt. % of carbon content in an conventional die steel, the hardness of its initial state can be lower than 38 HRC, which directly meets machining requirements, leaving out spheroidizing annealing process required for the existing die steel. With the heat treatment method provided by the present invention, due to the lower carbon content of the steel of the present invention, coarse primary carbides are unlikely to be generated. The temperature for solution treatment is reduced from above 1000° C. of the conventional die steel to 900~950° C., which lowers the requirements on the capability of the heat treatment apparatus, saves energy, reduces the production costs and enables the die to have better mechanical properties and excellent thermal conductivity. According to different requirements with regard to the processability, in a preferred condition when the carbon content in the steel of the present invention is 0~0.1 wt. %, no solution treatment is needed, which eliminates the process of solution treatment for the conventional die steel, further simplifying heat treatment requirements.

Yet another object of the present invention is to provide a hot-working die, whose primary carbides have sizes of less than 100 μm, secondary carbides, Cu precipitates and intermetallic compound NiAl precipitates have an average size of less than 10 nm, hardness value≥HRC 42, thermal conductivity≥35 W/mK, and the impact energy of an unnotched sample of 7×10 mm≥250 J, and the toughness thereof would not be significantly reduced due to precipitation hardening.

Technical Solution 1 of the present invention relates to a hot-working die steel, characterized in that its alloying composition by weight percentage comprises: Cu: 2-8%, Ni: 0.8-6%, wherein Ni:Cu≥0.4, C: 0~0.2%, Mo: 0~3%, W: 0~3%, Nb: 0~0.2%, Mn: 0~0.8%, Cr: 0~1%, the balance of Fe and other alloying elements and impurities.

Wherein Cu in the alloying design not only plays a role of precipitation strengthening, but also improves the thermal conductivity (firstly Cu itself has a characteristic of high thermal conductivity; secondly the matrix is purified after Cu precipitation from the matrix). The precipitated size of Cu is less than 10 nm, thereby having good toughness.

Preferably, the alloying composition of the hot-working die steel, by weight percentage, further comprises: 0-3% Al, and satisfying Ni:Al≥2.

Preferably, the alloying composition of the hot-working die steel, by weight percentage, further comprises: less than 3% Al, and satisfying Ni:Al is in the range of 2~2.5.

The present invention adds Ni element to suppress the liquation issue of Cu at high temperatures. Ni would reduce the thermal conductivity of the matrix. Therefore, during a hardening treatment, Ni and Al are precipitated as an intermetallic compound. The precipitated phase can maintain a coherent relationship with the matrix, purifying the matrix and improving the thermal conductivity. The average size of the precipitated phase is less than 10 nm, thereby having good toughness.

Preferably, the alloying composition of the hot-working die steel, by weight percentage, further comprises: 1). (Mo+W)≤6%; 2). (Mo+W): ⅔ C is in the range of 8~35; 3). Mo: ½ W≥0.5.

Technical Solution 2 of the present invention relates to a heat treatment method, which comprises carrying out the following steps on the hot-working die steel of Technical Solution 1: a) hardening heat treatment: holding at 400~550° C. for 0.1 to 96 hours, and then cooling to room temperature in any manner.

Preferably, the hardening heat treatment holds at 450~550° C. for 2 to 24 hours.

Preferably, the manner of cooling to room temperature is air cooling.

Preferably, after the hardening heat treatment, the properties of the steel are: hardness≥HRC 42, thermal conductivity≥35 W/mK, and impact energy at room temperature of an unnotched sample of 7×10 mm≥250 J.

Preferably, after the hardening heat treatment, the microstructure of the steel comprises: Cu precipitates of 10,000 to 20,000 pieces/$\mu m^3$, with an average size of less than 10 nm.

Preferably, after the hardening heat treatment, the microstructure of the steel further comprises: NiAl intermetallic compound precipitates of 10,000 to 20,000 pieces/$\mu m^3$, with an average size of less than 10 nm.

Preferably, after the hardening heat treatment, the microstructure of the steel, by area, further comprises: less than 2% alloy carbides of Mo and W, the average size of the primary carbides thereof is less than 100 nm, and the average size of the secondary carbides is less than 10 nm.

Wherein a large amount of Cr carbide precipitates in the existing die steel would reduce the thermal conductivity, and the size is usually in the order of 100 nm, which would also reduce the toughness. It is designed via reasonable alloying proportions that Mo: ½ W≥0.5, and (Mo+W): ⅔ C is in the range of 8~35. It is designed via controlling the volume fraction of the carbides. First of all, Mo, W carbides have high thermal conductivity, and when satisfying this condition, the size of the primary precipitates of Mo, W is less than 100 nm, and the size of the secondary precipitates is less than 10 nm, thereby achieving good toughness.

Preferably, the heat treatment method is further characterized in that, before a) the step of the hardening heat treatment, b) solution treatment is also performed: holding at 800~1200° C. for 0.1 to 72 hours, and then cooling to room temperature in any manner.

The solution treatment temperature of 800~1200° C. can ensure that Cu and carbides can dissolve into the matrix after being dissolved during an isothermal process.

The solution treatment of the die steel is mainly aimed to dissolve the carbides in the steel into the matrix after being dissolved, so that the carbides can re-nucleate during a subsequent hardening treatment. Solution treatment can also eliminate banded segregation to a certain extent. However, if the solution treatment temperature is high, austenite grains are prone to coarsening, which deteriorates the toughness of the material.

In the present invention, the ratios and contents of Mo, W and C are controlled so that no coarse carbides would be formed during a solidification process. During a subsequent forming (forging, rolling, etc., usually at a temperature of 900~1200° C.) process, the carbides further would be dissolved. In a cooling process after deformation (no matter air cooling or oil cooling), the carbides can be precipitated. However, the cooling time is always not sufficient for the carbides to grow up, and Cu and NiAl also need a long-time isothermal process to be precipitated. Therefore, in the present invention, the step of solution treatment is not necessary. When the carbon content is 0~0.1 wt. % and the Cu content is 2~6 wt. %, this heat treatment can be omitted, i.e., directly performing hardening treatment. The purpose of performing solution treatment is only to make the grain size more uniform, and eliminate segregation to a certain extent, thereby optimizing the performance of the die.

Preferably, the solution treatment temperature is 900~950° C.

Preferably, after an isothermal process in the solution treatment, the manner of cooling to room temperature is air cooling.

Preferably, after the solution treatment, the hardness of the steel is ≤HRC 38.

Technical Solution 3 of the present invention relates to a hot-working die, the alloying composition thereof by weight percentage comprises: Cu: 2~8%, Ni: 1~6%, and Ni:Cu≥0.5, C: 0~0.2%, Mo: 0~3%, W: 0~3%, Nb: 0~0.2%, Mn: 0~0.8%, Cr: 0~1%, the balance of Fe and other alloying elements and impurities.

Preferably, the properties of the hot-working die are: hardness≥HRC 42, thermal conductivity≥35 W/mK, and impact energy of an unnotched sample of 7×10 mm≥250 J.

Preferably, the hot-working die is used for a hot stamping die for a steel plate, an aluminium alloy die casting, a plastic hot-working die, and the like.

By means of reasonable alloying proportions, the invention ensures that alloy carbides, Cu and NiAl are sufficiently precipitated from the matrix during hardening treatment process. These precipitates have a characteristic of high thermal conductivity, such that the alloy has high thermal conductivity, which improves the resistance to hot cracking and in turn increases the service life of the material. Moreover, a die of high thermal conductivity can shorten the cycle time in production, thereby increasing production efficiency.

In the present invention, the precipitates of the primary carbides have a size of less than 100 μm, the precipitates of the secondary carbides have a size of less than 10 nm (as shown in FIG. 1), and Cu precipitates and NiAl precipitates both have sizes of less than 10 nm. After hardening treatment, the material's hardness is improved without greatly reducing the toughness due to the small size of the precipitates. In other words, the material has both high toughness and high hardness.

The heat treatment method involved in the present invention eliminates spheroidizing annealing process required for the existing die steels. The solution treatment temperature can be decreased from above 1000° C. to 900° C., which lowers the requirements for the heat treatment apparatus. Existing heat treatment apparatuses can be used to fulfil the task.

DETAILED DESCRIPTION OF THE INVENTION

The technical solution of the present invention will be described below with reference to the embodiments.

The chemical composition of the steel used for a hot-working die in the present invention comprises by weight percentage: Cu: 2~8%, Ni: 0.8~6%, and Al: 0~3%. In addition to the above components, its alloying composition also comprises: C: 0~0.2%, Mo: 0~3%, W: 0~3%, Nb: 0~0.2%, Mn≤0.8, Cr≤1.0, and satisfying Ni:Cu≥0.4, Ni:Al≥2, (Mo+W)<6%, Mo:½ W≥0.5, (Mo+W):⅔ C is in the range of 8~35, the balance of Fe and other alloying elements and impurities. The functions and proportions of the elements in the present invention are as follows.

Figure 1:
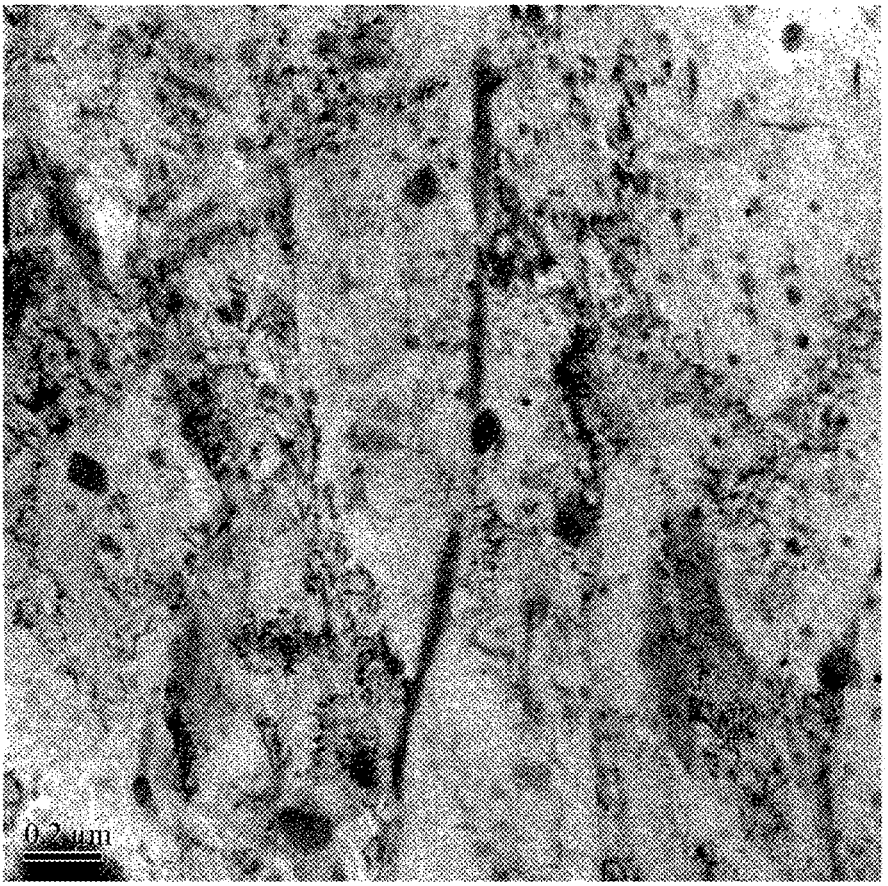
FIG. 1 shows the morphology and size of carbide precipitates.
Figure 2:
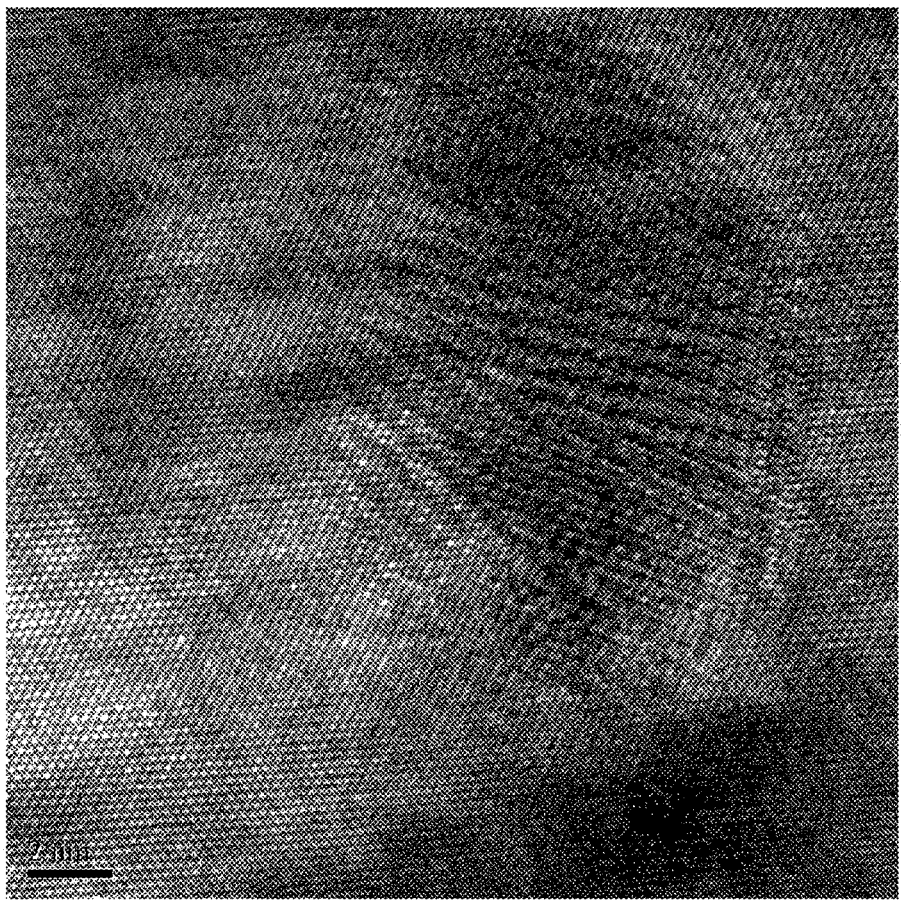
FIG. 2 shows the high-resolution morphology and size of Cu precipitates.

Cu: As a good conductor of heat, pure copper has thermal conductivity of 398 W/mK, while pure iron only 80 W/mK. The solubility of Cu is very high in a face-centred cubic phase (austenite), but very low in a body-centred cubic phase (ferrite and martensite), so elemental copper can be sufficiently precipitated in a large amount (as shown in FIG. 2). The size of the precipitated Cu is about 3~10 nm. Adding 1% by weight percentage of Cu contributes about 100 HV to hardness. Cu is precipitated from the body-centred cubic matrix (ferrite and/or martensite), which reduces the distortion of the crystal structure of the matrix, improving the thermal conductivity of the matrix. Moreover, the precipitated elemental Cu has very high thermal conductivity as well. However, during a hot forming (rolling, forging, etc.) process of a Cu-containing steel, Cu is prone to form liquid Cu at the grain boundaries of austenite. Hot cracks would be induced in the material during deformation due to the liquation phase at the grain boundaries, reducing the plastic deformation ability of the material and in turn making it impossible to be machined. Therefore, a certain weight percentage of alloying element Ni is always added into Cu-containing steel. Ni can inhibit Cu liquation at grain boundaries. Considering the strengthening effect of Cu and alloying cost, the copper content of the steel of the present invention is between 2% and 8%.

Ni: The main function of nickel in the present invention is to inhibit forming liquation phase of Cu at grain boundaries at high temperatures, which leads to the occurrence of hot cracking phenomenon of the alloy during deformation at high temperatures. When the weight ratio is Ni:Cu≥0.4, Ni can inhibit the liquation of Cu, thereby ensuring the hot forming performance of the alloy. The alloying element Ni can improve the hardenability of steel, and Ni concentrated at grain boundaries can improve the toughness. However, considering the price and function of Ni element and the fact that an excessively high amount of Ni element reduces the thermal conductivity of the matrix, the nickel content of the steel of the present invention is between 0.8% and 6%.

Figure 3:
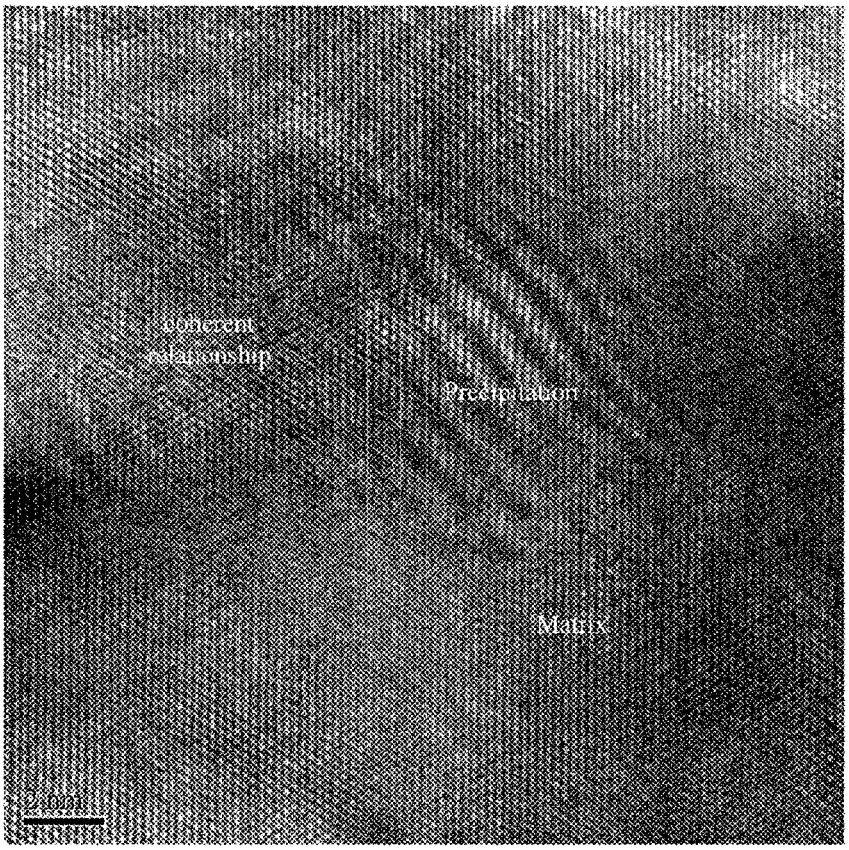
FIG. 3 shows the high-resolution morphology and size of the NiAl precipitates and the coherent relationship with the matrix.

Al: Aluminium element can form NiAl intermetallic compound with nickel element during an aging process at 400~550° C. (as shown in FIG. 3), wherein the relative atomic mass ratio of Ni to Al element is 2.15. In order to ensure that Ni and Al can be sufficiently precipitated in the form of intermetallic compound NiAl, the amounts of Ni and Al should not be excessive (not dissolve into the matrix; precipitated in the form of intermetallic compound to the greatest extent). At the same time, to reduce the smelting cost after adding Al and the influence of Al on the thermal conductivity, the weight percentages of Ni to Al is set in the range of 2~2.5 in the present invention. Al element can precipitate Ni from the matrix in the form of intermetallic compound, which further improves the purity of the matrix. Meanwhile, the intermetallic compound also has good thermal conductivity, which further contributes to possessing both high hardness and high thermal conductivity. However, an excessive amount of Al element on the one hand can increase the difficulty and cost of smelting, on the other hand tends to form larger-sized AlN inclusions, wherein AlN cannot completely dissolve in the austenite at high temperatures, which can seriously impair the toughness of steel. In addition, Al, as a strong ferrite stabilizing element, could increase $A_{c1}$ and $A_{c3}$ temperatures of steel. When solution treatment is required, it is bound to be at a higher temperature to achieve austenitization, thereby increasing manufacturing costs, increasing energy consumption and putting forward higher requirements for heat treatment apparatuses. Therefore, the aluminium content of the steel of the present invention is 0~3%.

C: As one of the most effective and economical strengthening elements in steel, carbon is an element that stabilizes austenite. Carbon is an interstitial solution element, and its strengthening effect is far greater than that of a substitutional solution element. Carbon can improve the hardenability of steel. The formed cementite or alloy carbides significantly increase the hardness of the alloy. The alloy carbides formed by carbon, molybdenum and tungsten alloying elements after high-temperature tempering not only enable the alloy to have good red hardness, resistance to hot cracking, and wear resistance, but also have higher thermal conductivity than chromium carbides. However, as the carbon content increases, twin martensite and larger-sized (micron-sized) carbides tend to be formed, resulting in deterioration of the toughness of the alloy. In addition, there are many strengthening manners in the present invention, which does not rely solely on the strengthening and hardening of carbides. Although the alloy carbides of molybdenum, tungsten alloy have higher thermal conductivity than that of chromium carbides, carbide precipitation can still reduce the thermal conductivity of the material. Therefore, the carbon content of the steel of the present invention is between 0 to 0.2%.

Mo, W: Molybdenum and tungsten could significantly improve the hardenability of steel, could effectively suppress the formation of ferrite, and significantly improve the hardenability of steel. It can also improve the weldability and corrosion resistance of steel. At the same time, the thermal conductivity of Mo and W carbides is higher than that of Cr carbides and cementite. The thermal conductivity of Mo carbides is higher than that of W carbides. An appropriate weight ratio of Mo to W is determined to ensure that W is fully precipitated in the form of $(Mo, W)_3Fe_3C$ carbides. Excess Mo forms separate Mo carbides, improving the thermal conductivity of the alloy. At the same time, Mo and W carbides are high-temperature carbides, ensuring that the material still has good wear resistance and hardness at high temperatures. The steel of the present invention comprises: Mo: 0~3%, W:

0~3%, and satisfying (Mo+W)≤6%, Mo:½ W≥0.5, (Mo+W):⅔ C is in the range of 8~35.

Nb: Even a small amount of niobium could form dispersed carbides, nitrides and carbonitrides of refined grains, improving the strength and toughness of steel. At the same time, even if the segregation of Nb atoms at the grain boundaries does not form carbonitrides, the drag effect of solute atoms could still refine austenite grains, improving the deformability of steel at high temperatures. During the hardening heat treatment, it is precipitated out of the matrix in the form of carbides, and would not affect the thermal conductivity of the matrix. The content of Nb in the present invention is 0~0.2%.

Mn: Manganese is dissolved in the matrix, which can reduce the thermal conductivity of the matrix. If Mn can completely form spherical MnS with S so that Mn does not dissolve in the matrix, the thermal conductivity can be increased. However, during smelting process, Mn cannot completely form MnS with S (because the content of S is controlled to be very low), and the formed MnS would not all be spherical. Larger-sized MnS inclusions seriously damage the toughness of steel, while Mn dissolved in the matrix would reduce the thermal conductivity of the matrix. Therefore, in the present invention, as an unavoidable impurity element, the content of Mn is required to be ≤0.8%.

Cr: When Cr is dissolved in the matrix, it can decrease the thermal conductivity of the matrix. Only when all Cr in the matrix is precipitated in the form of carbides, the damage to heat conduction can be alleviated. However, this cannot be achieved under practical conditions. At the same time, if the alloy contains Cr, when forming Mo, W carbides, Cr can dissolve in the Mo, W carbides to destroy the phonon order of the carbides, thereby reducing the thermal conductivity of the carbides. In the present invention, Mo, W carbides are used to substitute Cr carbides. Therefore, it is unnecessary to have Cr element in the present invention. However, it is impossible to eliminate Cr element completely in smelting.

In the present invention, as an unavoidable impurity element, the content of Cr is required to be ≤1%.

Impurity elements P, S, N, etc.: In general, phosphorus is a harmful element in steel, and could increase cold brittleness of steel, deteriorate weldability, reduce plasticity, and deteriorate the cold bending performance. It is required in the present invention that the content of P in the steel is less than 0.05%. Sulfur generally is also a harmful element, and causes hot brittleness of steel and reduces ductility and welding performance of steel. It is required in the present invention that the content of S in the steel is less than 0.015%. As an interstitial solution element, nitrogen can significantly increase the strength of steel. It is also an austenite stabilizing element, expands the austenite region and reduces $A_{c3}$ temperature. N tends to bond with Al and other strong nitride forming elements to form nitrides with a larger size, which reduces the toughness of steel. In the present invention, N is required to be less than 0.015%.

The present invention will be described below in more detail with reference to exemplary embodiments. The following embodiments or experimental data are intended to illustrate the present invention exemplarily, and it should be clear to those skilled in the art that the present invention is not limited to these embodiments or experimental data.

According to an embodiment of the present invention, a hot-working die steel with a preferred composition is provided, comprising the following components by weight: Cu: 2~8%, Ni: 0.8~6%, and Al: 0~3%. In addition to the above components, its alloying composition also comprises; C: 0.01~0.1%, Mo: 0~3%, W: 0~3%, Nb: 0~0.2%, Mn:≤0.8%, Cr:≤0.3% and satisfying Ni:Cu≥0.4, Ni:Al≥2, (Mo+W)≤6%, Mo:½ W≥0.5, (Mo+W):⅔ C is in the range of 8~35, the balance of Fe and other alloying elements and impurities. The compositions in the embodiments provided in the present invention are all within the above-mentioned component ranges, and the weight percentages of the related elements meet the above-mentioned conditions.

According to an embodiment of the present invention, a hot-working die steel with another preferred composition is provided, comprising the following components by weight: Cu: 4~8%, Ni: 2~4%, and Al: 1~2%. In addition to the above components, its alloying composition also comprises C: 0.1~0.2%, Mo: 0~3%, W: 0~3%, Nb: 0~0.2%, Mn:≤0.8%, Cr:≥0.3%, and satisfying Ni:Cu≥0.4, Ni:Al≥2, (Mo+W) ≤6%, Mo:½ W≥0.5, (Mo+W):⅔ C is in the range of 8~35, the balance of Fe and other alloying elements and impurities.

The steels of the present invention were smelted into steel ingots according to the designed compositions, forged at 1200° C. into 80×80 $mm^2$ square billets, homogenized at 1200° C. for 5 hours, and then air-cooled to room temperature. Subsequently, they were held at 1200° C. for 30 minutes under laboratory conditions before being hot rolled to 13 mm and thereafter air-cooled to room temperature.

Table 1 shows the compositions of exemplary steels HTC1-HTC5 of the present invention and compared steels CS1, CS2.

As for the compositions of the exemplary steels HTC1-HTC5, the weight ratio of Ni to Cu is about 0.5; the weight ratio of Mo to ½ W is about 0.5; and the weight ratio of (Mo+W) to ⅔ C is about 30. In HTC1-3, the weight ratio of Ni to Al is about 2. The compositions of the exemplary steels all meet the preferred composition of the hot-working die steel given above. After hardening treatment, Mo+W carbides, Cu precipitates, NiAl intermetallic compound and Nb carbides were formed.

In the compared steel CS1, the weight ratio of Ni to Cu is about 3.4; and the weight ratio of (Mo+W) to ⅔ C is about 10.9. The microalloying element V with a weight percentage of 0.18 is added. The affinity of V for C is higher than that of Mo and W. In the compared steel CS2, the weight ratio of (Mo+W) to ⅔ C is about 16.6. Due to high contents of C, Mo and W, various carbides were formed during the hardening treatment process.

TABLE 1

Compositions (weight percentage) of the exemplary steels of the present invention and the compared steels

| Steel grade | Cu | Ni | Al | C | Nb | Mo | W | Cr | Mn | Fe |
|---|---|---|---|---|---|---|---|---|---|---|
| HTC1 | 3.02 | 1.51 | 0.71 | 0.05 | 0.02 | 0.51 | 0.51 | 0.13 | 0.69 | Bal. |
| HTC2 | 5.03 | 2.49 | 1.23 | 0.05 | 0.02 | 0.52 | 0.51 | 0.15 | 0.72 | Bal. |
| HTC3 | 6.98 | 3.47 | 1.71 | 0.05 | 0.02 | 0.51 | 0.52 | 0.12 | 0.71 | Bal. |
| HTC4 | 3.01 | 1.49 | — | 0.102 | 0.02 | 1.01 | 1.03 | 0.14 | 0.67 | Bal. |
| HTC5 | 3.01 | 1.49 | — | 0.198 | 0.02 | 1.97 | 2.01 | 0.15 | 0.63 | Bal. |
| CS1 | 1.48 | 5.02 | 2.24 | 0.07 | — | 0.51 | — | 0.63 | 0.74 | Bal. |
| CS2 | — | — | — | 0.38 | — | 3.0 | 1.2 | 0.2 | 0.3 | Bal. |

The heat treatment method of the present invention includes the following steps: machining the hot-rolled steel into samples of 7.2×10×55 mm and cylindrical samples of φ12.7×2.2 mm.

Wherein the compared steel 1 has an ultra-low carbon content and a high aluminium content; therefore, ferrites underwent phase transformation during solidification cannot be completely austenitized during the subsequent hot rolling process. As a result, during the rolling process, a banded structure would inevitably be formed, causing the anisotropy of the material, which reduces the performance of the material. Therefore, solution treatment is performed at 1020° C. Its main purpose is to enable the ferrites to recover and recrystallize so as to obtain a microstructure with a uniform size of all phases. Without this heat treatment process, the die certainly would fail prematurely in use due to anisotropy, shortening the service life. Since strong austenite stabilizing element Cu of a higher content and Al of a lower content than in CS1 were added to the exemplary steels HTCS1-5, complete austenitization can be achieved during the hot-rolling process, so no banded structure was formed.

Due to its high hardness after hot rolled, the compared steel CS2 needs to undergo spheroidizing annealing process before machining. The annealing temperature is 880° C., and the annealing time is 6 h. It is then air-cooled to room temperature. Spheroidizing annealing is an annealing process in which the carbides in the steel are spheroidized to obtain a structure of spherical or granular carbides uniformly distributed in the ferrite matrix, thereby reducing the hardness and improving the machinability. The spheroidized structure not only has better plasticity and toughness than a lamellar structure, but also has a slightly lower hardness. In addition, as recited in relevant literature, the compared steel CS2 is a chromium-molybdenum hot-working die steel, and its industrial quenching temperature is 1020~1050° C. At this temperature, most carbides of Mo and W could be dissolved.

After solution treatment (solution temperature was 900° C. for the exemplary steels; solution temperature was 1020° C. for the compared steels)/no solution treatment, it was cooled to room temperature in any manner, and then hardened at 400~550° C. (the exemplary steels), 550° C.~580° C. (the compared steels), before being air-cooled to room temperature. The solution treatment and hardening treatment process parameters for the exemplary steels and the compared steels are listed in Table 2.

It is known to all that hardening effect is related to both hardening treatment temperature and hardening time. As hardening temperature/time increases, hardening effect presents a trend of increasing to the maximum value and then decreasing. The trend of the hardening effect is opposite to the toughness, that is, the better the hardening effect, the worse the toughness. Hardening treatment processes which can achieve the best combination of hardness and toughness are selected, respectively, for the exemplary steels of the present invention and the compared steels. The process exploration procedure and results on hardening effect-temperature/time for the exemplary steels and the compared steels will not be shown herein. The specification only gives the optimized hardening processes. During the hardening treatment process, 500° C. witnesses a secondary hardening peak and the highest tempering hardness, but the worst toughness. Therefore, the secondary hardening peak temperature shall be avoided during the hardening treatment before use. A good combination of hardness and toughness can be achieved when choosing 580° C. to carry out the hardening treatment. In order to avoid coarsening carbides, a 2 h+2 h secondary hardening manner is selected.

TABLE 2

Solution treatment and hardening treatment process parameters for the exemplary steels of the present invention and the compared steels

| Steel grade | Solution temperature/° C. | Solution time/h | Hardening temperature/° C. | Hardening time/h |
|---|---|---|---|---|
| HTC1 | — | — | 450 | 24 |
| HTC1' | 900 | 1 | 450 | 24 |
| HTC2 | — | — | 400 | 48 |
| HTC3 | — | — | 450 | 16 |
| HTC4 | — | — | 500 | 8 |
| HTC5 | — | — | 550 | 2 |
| HTC5' | 900 | 1 | 550 | 2 |
| CS1 | 1020 | 1 | 580 | 2 + 2 |
| CS2 | 1020 | 1 | 580 | 2 + 2 |

After the hardening treatment, samples of 7.2×10×55 mm were polished with sandpaper. After the surfaces were polished to be bright, the hardness of the samples obtained under different hardening temperatures and hardening times were measured with a hardmeter. Rockwell hardness is used as the hardness measurement mode. Table 3 shows the hardness values of the exemplary steels and the compared steels after hot rolled. Table 4 shows the hardness values of the exemplary steels and the compared steels after the hardening treatment.

TABLE 3

Hardness values (HRC) of the exemplary steels of the present invention and the compared steels after hot rolled

| Steel grade | HTC1 | HTC2 | HTC3 | HTC4 | HTC5 | CS1 | CS2 |
|---|---|---|---|---|---|---|---|
| Hardness | 32.2 | 33.1 | 35.3 | 37.8 | 37.1 | 32.5 | 42.4 |

TABLE 4

Hardness values (HRC) of the exemplary steels of the present invention and the compared steels after the hardening treatment

| Steel grade | HTC1 (No solution treatment) | HTC1' (solution treatment) | HTC2 ((No solution treatment) | HTC3 (No solution treatment) | HTC4 (No solution treatment) | HTC5 (No solution treatment) | HTC5' (solution treatment) | CS1 (solution treatment) | CS2 (solution treatment) |
|---|---|---|---|---|---|---|---|---|---|
| Hardness | 49.1 | 49.2 | 50.1 | 52.2 | 50.1 | 54.1 | 54.1 | 48.1 | 51.2 |

The hardness values of the exemplary steels HTC1-5 after hot rolled are all lower than HRC 38. This is because Cu precipitates and NiAl as hardening phases are not precipitated at all after hot rolling the exemplary steels, achieving no strengthening effect. Since the ratio of the alloying elements has been adjusted during designing the alloy, Mo, W carbides have fine morphologies and are dispersed in the matrix, and thereby would form no lamellar carbides. Therefore, the exemplary steels have low hardness values, and can be machined directly without performing spheroidizing annealing treatment.

The hardness value of the compared steel CS1 after hot rolled is similar to those of the exemplary steels. The reason is that Cu is not precipitated and there are not many carbides. The compared steel CS2 has only carbides as its strengthening phase. During a cooling process after hot rolled, a lamellar pearlite structure and carbides were formed. Therefore, its hardness exceeds HRC 42 and cannot be machined. It can only be machined after being softened through performing spheroidizing annealing.

After being treated by the hardening treatment processes shown in Table 2, the precipitates in the exemplary steels HTC1-5 are alloy carbide $(Mo,W)_3Fe_3C$ precipitates, Cu precipitates, intermetallic compound NiAl precipitates, and further includes NbC precipitates.

Table 5 shows the area fractions and average sizes of the precipitated phases of the exemplary steels and the compared steels after the hardening treatment.

TABLE 5

The area fractions and average sizes of the precipitated phases of the exemplary steels and the compared steels after the hardening treatment

| Precipitated phase | Cu (pieces/ $\mu m^3$) | NiAl (pieces/ $\mu m^3$) | Carbides (Fraction) | Primary/ secondary carbides (Average size, nm) | VC (Fraction/ Average size, nm) |
|---|---|---|---|---|---|
| HTC1 | 12514 | 16948 | 0.31% | 73 nm/7.5 nm | — |
| HTC2 | 17625 | 19786 | 0.29% | 79 nm/7.7 nm | — |
| HTC3 | 19457 | 11376 | 0.34% | 81 nm/7.3 nm | — |
| HTC4 | 11982 | 0 | 1.5% | 81 nm/8.4 nm | — |
| HTC5 | 12007 | 0 | 2.0% | 85 nm/9.1 nm | — |
| CS1 | 9765 | 20531 | 0.2% | 107.8 nm/9.6 nm | 0.15%/ 9.3 nm |
| CS2 | — | — | 6.3% | 123.4 nm/21.6 nm | 0.9%/ 21.4 nm |

The compared steel CS1 contains precipitates of Cu and precipitates of Mo carbides. CS2 has only carbides as its strengthening phase, and includes Cr carbides, VC, and Mo and W carbides.

After the hardening treatment, the samples of 7.2×10×55 mm were mechanically polished into unnotched impact specimens of 7×10×55 mm according to the unnotched impact specimen standard of North American Die Casting Association. 450 J pendulum impact tests at room temperature were carried out on the unnotched specimens. Table 6 shows the impact energy of the unnotched specimens at room temperature of the exemplary steels HTC1-HTC5 and the compared steels CS1 and CS2.

TABLE 6

Impact energy (J) at room temperature of the unnotched specimens (7 × 10 × 55 mm) of the exemplary steels of the present invention and the compared steels

| Steel grade | HTC1 (No solution treatment) | HTC1' (solution treatment) | HTC2 (No solution treatment) | HTC3 (No solution treatment) | HTC4 (No solution treatment) | HTC5 (No solution treatment) | HTC5' (solution treatment) | CS1 (solution treatment) | CS2 (solution treatment) |
|---|---|---|---|---|---|---|---|---|---|
| Impact energy | 357 | 356 | 326 | 293 | 274 | 259 | 257 | 271 | 196 |

The impact energy of the exemplary steels HTC1-5 and the compared steel CS1 is both greater than 250 J, and the impact energy of the compared steel CS2 does not exceed 200 J. Overall, during the hardening treatment process of the exemplary steels HTC1-5, the precipitated strengthening phases are Mo, W carbides, pure Cu precipitates, intermetallic compound NiAl, and microalloy carbides. The precipitation temperatures of these precipitated phases approach to each other, which can ensure that all phases can be precipitated at the same temperature, thereby ensuring the performance. Moreover, due to the reliance on the precipitation strengthening of the substitutional elements Cu, Ni and Al (their diffusion ability in the matrix is much weaker than that of C element), so the sizes of their precipitated phases are relatively small, leading to a significant hardening effect of the precipitated phases, and the influence on the impact toughness is lower than the compared steel CS2. Although the compared steel CS1 contains Cu precipitates, the amount thereof is small. The precipitated phase in CS2 comprises only carbides. When the temperature is lower than 500° C., its precipitated phase is precipitated in a very small amount. 500° C. is the secondary hardening peak temperature, leading to the maximum hardness of the steel, but the worst toughness. Being held at 580° C. for 2 hours and tempered twice is to reach a balance between toughness and hardness. However, the size of its large carbides is between 0.5 and 3 μm, which is still much coarser than Cu precipitates and NiAl precipitates of 3~10 nm. The large carbides greatly affect the toughness. Therefore, its impact energy is less than 200 J.

After the exemplary steels HTC1-5 and the compared steels CS1 and CS2 were hardened according to the hardening processes in Table 2, the cylindrical samples of φ12.7×2.2 mm were ground into φ12.7×2.0 mm with 1000-mesh sandpaper. The thermal conductivity was measured on a DLF2800 flash conductometer. The measurement process was: increasing to 100° C. from 25° C. at a rate of 5 K/min; stabilizing at 100° C. for about 10 minutes and then carry out a measurement; thereafter stabilizing for another 10 minutes and carrying out a second measurement; thereafter stabilizing for yet another 10 minutes and carrying out a third measurement. After the three measurements, the temperature was increased to 200° C. at the rate of 5 K/min, and in sequence to 400° C., 500° C., and 600° C. in the same way, before being cooled to room temperature (equivalent to being held at the test temperature for 30 minutes), to obtain data of the thermal diffusivity and the specific heat capacity.

The thermal conductivity of the alloy is calculated from the thermal diffusivity, the specific heat capacity and the density.

Since the actual measurement temperature is different from the required measurement temperature (for example, the desired temperature is 400° C., but the actual temperature measured is 396° C.), the measured thermal diffusivity—the temperature curves were fitted by polynomial to obtain the thermal diffusivity at integer temperatures. The basis for this is that the thermal diffusivity is a continuous function of temperature. Likewise, the specific heat data must be fitted with the specific heat capacity data of pure iron to obtain the specific heat capacity data at integer temperatures.

Thermal conductivity coefficient $\lambda=\alpha\times c_p\times\rho\times100$. The unit of thermal diffusivity coefficient $\alpha$ is $cm^2/s$. The unit of specific heat capacity $c_p$ is J/(gK). The unit of density is $g/(cm^3)$. The unit directly worked out is W/(CmK)×100, and the obtained unit is W/(mK).

Figure 4:
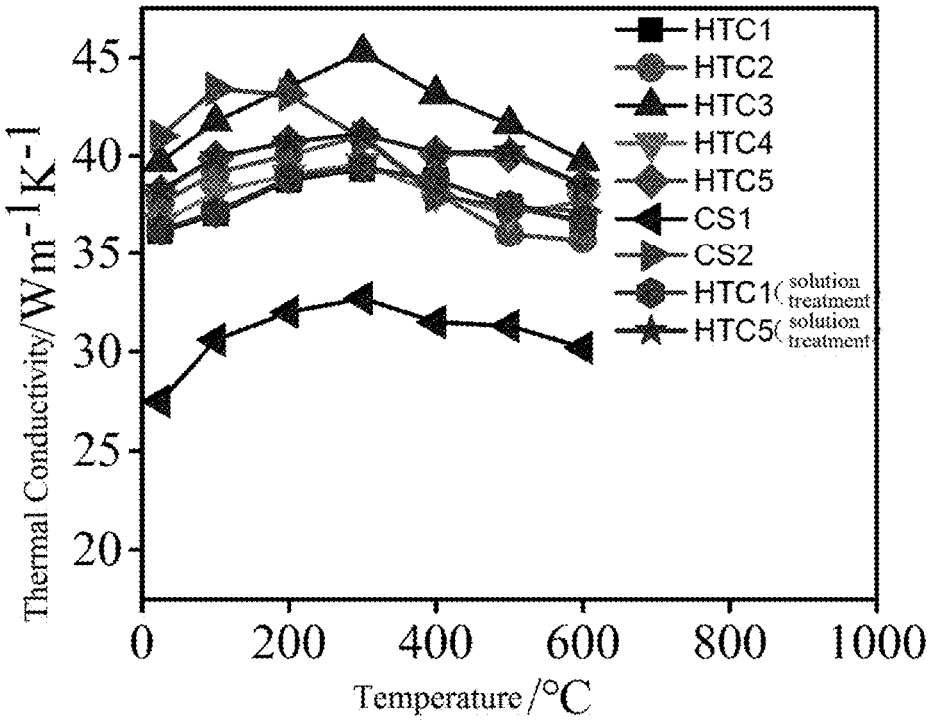
FIG. 4 shows the relationship between thermal conductivity and temperature of exemplary steels and compared steels.

The thermal conductivity data at 20~600° C. of the exemplary steels and the compared steels obtained through measurement and calculation are shown in Table 7 and the curves thereof are in FIG. 4. It can be seen from FIG. 4 that the Cu content in the compared steel CS1 is lower than that in the exemplary steels HTCS1-5, which is a reason for its low thermal conductivity.

TABLE 7

Thermal conductivity (W/(mK)) of the exemplary steels of the present invention and the compared steels at 25~600° C.

| Temperature | HTC1 (No solution treatment) | HTC2 (No solution treatment) | HTC3 (No solution treatment) | HTC4 (No solution treatment) | HTC5 (No solution treatment) | CS1 (No solution treatment) | CS2 (No solution treatment) | HTC1' (solution treatment) | HTC5' (solution treatment) |
|---|---|---|---|---|---|---|---|---|---|
| 25 | 36.15 | 37.60 | 39.70 | 36.60 | 38.16 | 21.12 | 20.11 | 36.25 | 38.26 |
| 100 | 37.05 | 39.14 | 41.75 | 38.14 | 39.90 | 22.01 | 22.03 | 37.15 | 39.93 |
| 200 | 38.77 | 40.04 | 43.50 | 39.04 | 40.70 | 22.72 | 23.20 | 38.87 | 40.73 |
| 300 | 39.34 | 41.01 | 45.27 | 39.62 | 41.09 | 24.24 | 24.01 | 39.44 | 41.11 |
| 400 | 38.80 | 38.11 | 43.16 | 38.11 | 40.15 | 25.15 | 25.13 | 38.80 | 40.16 |
| 500 | 37.441 | 36.03 | 41.61 | 37.03 | 40.04 | 25.42 | 25.34 | 37.46 | 40.24 |

The impact energy-hardness-thermal conductivity curves of the exemplary steels and the compared steels are shown in Table 8.

TABLE 8

Hardness, impact energy and thermal conductivity of the exemplary steels of the present invention and the compared steels

| Steel grade | Thermal conductivity/W/(mK) | Impact energy/J | Hardness/HRC |
|---|---|---|---|
| HTC1 | 39 | 357 | 49.1 |
| HTC2 | 41 | 326 | 50.1 |
| HTC3 | 45 | 293 | 52.2 |
| HTC4 | 38 | 274 | 50.1 |
| HTC5 | 40 | 259 | 54.1 |
| CS1 | 32 | 271 | 48.1 |
| CS2 | 43 | 196 | 51.2 |

As can be seen from Table 8, the impact energy of the exemplary steels HTC1-5 is all greater than 250 J, the hardness values are greater than HRC 42, and the thermal conductivity is greater than 35 W/mK. Although the impact energy of the compared steel CS1 is greater than 250 J and the hardness value is greater than HRC 42, its thermal conductivity is 32 W/mK. Although the compared steel CS2 has high hardness (HRC 51.2) and higher thermal conductivity (43 W/mK), the toughness thereof is poor and the impact energy is much lower than that of the exemplary steels HTCS1-5.

In a preferred condition, there is no essential difference in hardness, impact energy, and thermal conductivity of the die steel designed in the present invention with solution treatment and without solution treatment. The reason why the exemplary steels HTC1-5 have high hardness, high toughness and high thermal conductivity at the same time is that: after alloying elements are added into the steel, on the one hand, Mo, W, Ni are all alloying elements that improve thermal conductivity; Mo, W carbides have a higher thermal conductivity than Cr carbides and cementite $Fe_3C$. Even if Ni dissolves into the matrix, it would still improve the thermal conductivity of the matrix; on the other hand, during the hardening treatment process, the alloying elements are sufficiently precipitated from the matrix. The precipitates have fine sizes. The average sizes of Cu, intermetallic compound NiAl, and secondary carbides $(Mo, W)_3Fe_3C$ are all less than 10 nm. Even if the precipitated phases of Cu and intermetallic compound NiAl underwent overaging, their sizes would not exceed 10 nm. The preferred hardening temperature prevents the carbides from coarsening. Finally, NiAl maintains a coherent relationship with the matrix after precipitation, which would not induce the distortion of the crystal structure of the matrix, facilitating heat conduction. These three aspects together lead to the high hardness, high toughness and high thermal conductivity of the hot-working die steel of the present invention. In contrast, in the compared steel CS1, since a high content of V is added, on the one hand an excessive amount of V causes the distortion of the crystal structure of the matrix, and on the other hand, VC does not have good thermal conductivity. As for the compared steel CS2, since it has a high content of C and a large amount of Mo, W elements is added, so carbides of a coarse size are prone to be formed. Although these carbides themselves have good thermal conductivity and at the same time improve the hardness of the material, they significantly deteriorate the toughness. The impact energy does not exceed 200 J. During use, the die would prematurely fracture due to poor toughness, leading to directly fail of the die without an opportunity for repair.

In summary, as for the hot-working die of the present invention, the dissolved alloying elements are sufficiently precipitated out of the matrix. Metal precipitates, intermetallic compound precipitates, and carbide precipitates all have good thermal conductivity, and the precipitated sizes thereof are less than 10 nm. Therefore, the thermal conductivity of the alloy is increased after the hardening heat treatment, thereby avoiding the deterioration of toughness caused by hardening. Moreover, the production process for the existing die steel is simplified, reducing the manufacturing cost. Manufacturing is carried out by the existing heat treatment and processing equipment.

The hot-working die of the present invention can be used for a hot stamping die for a steel plate, an aluminium alloy die casting, a plastic hot-working die and the like.

The above embodiments and experimental data are intended to exemplarily illustrate the present invention. It should be clear to those skilled in the art that the present invention is not limited to these embodiments, and various changes can be made without departing from the protection scope of the present invention.

What is claimed is:

1. A hot-working die steel, wherein an alloying composition by weight percentage comprises Cu: 5.03~8%, Ni: 0.8~6%, and Ni:Cu≥0.4, C: 0~0.198%, Mo: 0~3%, W: 0~3%, Nb: 0~0.2%, Mn: 0~0.8%, Cr: 0~1%, Al: 0~3%, the balance of Fe and impurities, and wherein a hardness of the hot-working die steel is ≥HRC 50.1.

2. The hot-working die steel according to claim 1, wherein the alloying composition satisfies Ni:Al≥2.

3. The hot-working die steel according to claim 1, wherein Ni:Al is in the range of 2~2.5.

4. The hot-working die steel according to claim 1, wherein, by weight percentage, the alloying composition further comprises:

(Mo+W):⅔C is in the range of 8~35; and

Mo:½W≥0.5.

5. A heat treatment method to obtain the hot-working die steel according to claim 1, wherein the heat treatment method is performed on a hot rolled steel having a composition comprising, in weight percentage Cu: 5.03~8%, Ni: 0.8~6%, and Ni:Cu≥0.4, C: 0~0.198%, Mo: 0~3%, W: 0~3%, Nb: 0~0.2%, Mn: 0~0.8%, Cr: 0~1%, Al: 0~3%, the balance of Fe and impurities, the method comprising:

a) hardening heat treatment: holding at 400~550° C. for 0.1 to 96 hours, and then cooling to room temperature in any manner.

6. The heat treatment method according to claim 5, wherein the hardening heat treatment comprises holding at 450~550° C. for 2 to 24 hours.

7. The heat treatment method according to claim 5, wherein the manner of cooling to room temperature is air cooling.

8. The heat treatment method according to claim 5, wherein after the hardening heat treatment, the properties of the steel are: hardness≥HRC 50.1, thermal conductivity≥35 W/mK, and impact energy at room temperature of an unnotched sample of 7×10 mm≥250 J.

9. The heat treatment method according to claim 5, wherein after the hardening heat treatment, the microstructure thereof includes Cu precipitates of 10,000 to 20,000 pieces/$\mu m^3$, with an average size of less than 10 nm.

10. The heat treatment method according to claim 9, wherein after the hardening heat treatment, the microstructure thereof further comprises: NiAl intermetallic compound precipitates of 10,000 to 20,000 pieces/$\mu m^3$, with an average size of less than 10 nm.

11. The heat treatment method according to claim 9, wherein after the hardening heat treatment, the microstructure thereof further comprises less than 2% by area alloy carbides of Mo and W, wherein the average size of primary carbides are less than 100 nm, and the average size of secondary carbides are less than 10 nm.

12. The heat treatment method according to claim 5, further comprising: before the step of a) the hardening heat treatment, also performing:

b) solution treatment: holding at 800~1200° C. for 0.1 to 72 hours, and then cooling to room temperature in any manner.

13. The heat treatment method according to claim 12, wherein the solution treatment comprises holding at 900~950° C. for 0.1 to 72 hours.

14. The heat treatment method according to claim 12, wherein after holding at a temperature during the solution treatment, the manner of cooling to room temperature is air cooling.

15. The heat treatment method according to claim 12, wherein after the solution treatment, the hardness of the steel≤38 HRC.

16. A hot-working die, comprising:

a hot-working die steel, wherein the hot-working die steel has been heat treated according to the heat treatment method according to claim 5, wherein the hot-working die steel has an alloying composition by weight percentage comprises Cu: 5.03~8%, Ni: 0.8~6%, and Ni:Cu≥0.4, C: 0~0.198%, Mo: 0-3%, W: 0~3%, Nb: 0~0.2%, Mn: 0~0.8%, Cr: 0~1%, Al: 0~3%, the balance of Fe and impurities, and wherein a hardness of the hot-working die steel is ≥HRC 50.1.

17. The hot-working die according to claim 16, wherein an unnotched sample of 7×10 mm of the hot-working die has an impact energy at room temperature of ≥250 J.

18. The hot-working die according to claim 16, comprising: a hot stamping die for a steel plate, an aluminium alloy die casting, a plastic hot-working die, a hot forging die, a hot extrusion die, a die-casting die, or a hot upset forging die.

19. The hot-working die steel according to claim 1, wherein C is 0.05~0.102%.

20. The hot-working die steel according to claim 1, wherein an unnotched sample of 7×10 mm of the hot-working die has an impact energy at room temperature of ≥250 J.

21. The hot-working die steel according to claim 1, wherein a microstructure of the hot-working die steel includes Cu precipitates of 10,000 to 20,000 pieces/$\mu m^3$, with an average size of less than 10 nm.

22. The hot-working die steel according to claim 21, wherein the microstructure further includes NiAl intermetallic compound precipitates of 10,000 to 20,000 pieces/$\mu m^3$, with an average size of less than 10 nm.

23. The hot-working die steel according to claim 21, wherein the microstructure further includes less than 2% by area alloy carbides of Mo and W, wherein an average size of primary carbides are less than 100 nm, and an average size of secondary carbides are less than 10 nm.

24. The hot-working die steel according to claim 1, wherein a thermal conductivity of the hot-working die steel≥35 W/mK.

25. The hot-working die according to claim 16, wherein a thermal conductivity of the hot-working die steel≥35 W/mK.

* * * * *